US007448435B2

(12) United States Patent
Garozzo

(10) Patent No.: US 7,448,435 B2
(45) Date of Patent: Nov. 11, 2008

(54) SYSTEM AND METHOD FOR CONTROLLING A MULTI-ZONE HEATING OR COOLING SYSTEM

(75) Inventor: James P. Garozzo, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 702 days.

(21) Appl. No.: 11/063,819

(22) Filed: Feb. 23, 2005

(65) Prior Publication Data

US 2006/0185818 A1 Aug. 24, 2006

(51) Int. Cl.
*F25B 29/00* (2006.01)
*F25B 49/00* (2006.01)

(52) U.S. Cl. ..... 165/11.1; 165/200; 165/217; 236/46 R; 236/51; 236/94; 62/77; 62/127; 62/298

(58) Field of Classification Search ..... 165/11.1, 165/200, 217; 236/46 R, 51, 94; 62/77, 62/127, 298
See application file for complete search history.

(56) References Cited

U.S. PATENT DOCUMENTS 5,065,813 A * 11/1991 Berkeley et al. ..... 236/94
5,161,606 A * 11/1992 Berkeley et al. ..... 165/259
5,326,027 A * 7/1994 Sulfstede ..... 236/51
5,927,398 A 7/1999 Maciulewicz
5,950,709 A * 9/1999 Krueger et al. ..... 165/11.1
6,535,138 B1 3/2003 Dolan et al.
7,156,316 B2 * 1/2007 Kates ..... 236/1 B
7,163,156 B2 * 1/2007 Kates ..... 236/1 B
7,168,627 B2 * 1/2007 Kates ..... 236/1 B

* cited by examiner

*Primary Examiner*—John K Ford
(74) *Attorney, Agent, or Firm*—Harness, Dickey & Pierce, P.L.C.

(57) ABSTRACT

A control system is provided for automatically setting up and controlling a climate control system for a building having one or more zones and one or more thermostats in communication with the associated heating or cooling components of the climate control system. In some embodiments, the climate control system comprises one or more heating or cooling systems which may be controlled by one or more thermostats. In other embodiments, the climate control system comprises a thermostat, a heating and cooling system, one or more remote temperature sensors corresponding to at least some of the one or more zones within the building, and one or more dampers corresponding to at least some of the one or more zones within the building.

9 Claims, 3 Drawing Sheets

SYSTEM AND METHOD FOR CONTROLLING A MULTI-ZONE HEATING OR COOLING SYSTEM

FIELD OF THE INVENTION

This invention generally relates to a system and method for controlling a climate control system for a building having one or more zones, and more specifically to automatically setting up a system for controlling multi-zone climate control systems.

BACKGROUND OF THE INVENTION

Multiple heating and cooling systems are often utilized for conditioning buildings having multiple zones or levels. The installation of multiple systems in such buildings can involve the installation of several thermostats and the complex set-up and wiring of each heating or cooling system component to the thermostats within the building.

SUMMARY OF THE INVENTION

The present invention relates to a control system for automatically setting up and controlling a climate control system for a building having one or more zones and one or more heating or cooling systems and components in communication with at least one thermostat. In some embodiments, the climate control system comprises one or more heating or cooling systems which may be controlled by one or more thermostats. In other embodiments, the climate control system comprises a thermostat, a heating or cooling system, one or more remote temperature sensors corresponding to at least some of the one or more zones within the building, and one or more dampers corresponding to at least some of the one or more zones within the building.

In accordance with one aspect of the present invention, one embodiment of a control system is provided for a climate control system that comprises at least one thermostat, one or more unassigned HVAC systems, and one or more unassigned remote temperature sensors. The climate control system may further comprise one or more unassigned damper control devices corresponding to at least some of the one or more zones within the building, where each damper controllably permits the flow of conditioned air to at least one of the zones. In another embodiment of the present. invention, a control system is provided for setting up a climate control system that comprises a thermostat having a local temperature sensor and two or more heating or cooling systems for controlling the conditioning of one or more zones within a building. The climate control system further comprises one or more remote temperature sensor devices disposed in at least some of the one or more zones within the building. In the control system of this embodiment, the thermostat is adapted to communicate with at least one of the two or more heating or cooling systems and the one or more temperature sensors. The thermostat further includes a set-up mode that initiates the operation of one of the two or more heating or cooling systems that are not assigned, and responsively assigns the operating heating and cooling system to the thermostat where the local temperature sensor detects a temperature change corresponding to the operation of the heating or cooling system.

In accordance with another aspect of the present invention, another embodiment of a control system is provided that comprises first and second thermostats each having a local temperature sensor, where the second thermostat device also initiates a set-up mode upon power up. The second thermostat device initiates the operation of one of the two or more heating or cooling systems not assigned to first thermostat, and responsively assigns the operating heating or cooling system to the second thermostat where the local temperature sensor detects a temperature change corresponding to the operation of the heating or cooling system. After assigning a heating and cooling system to the second thermostat, the second thermostat device initiates the operation of its assigned heating or cooling system and responsively assigns to the second thermostat each unassigned temperature sensor device that detects a temperature change corresponding with temperature change sensed by the temperature sensing device of the second thermostat.

Further aspects of the present invention will become apparent from the detailed description provided hereinafter. It should be understood that the detailed description and specific examples, while indicating various embodiments and methods of the invention, are for illustration purposes only and are not intended to limit the scope of the invention.

BRIEF DESCRIPTION OF THE DRAWINGS

Corresponding reference numerals indicate corresponding parts throughout the several views of the drawings.

DETAILED DESCRIPTION OF THE INVENTION

Figure 1:
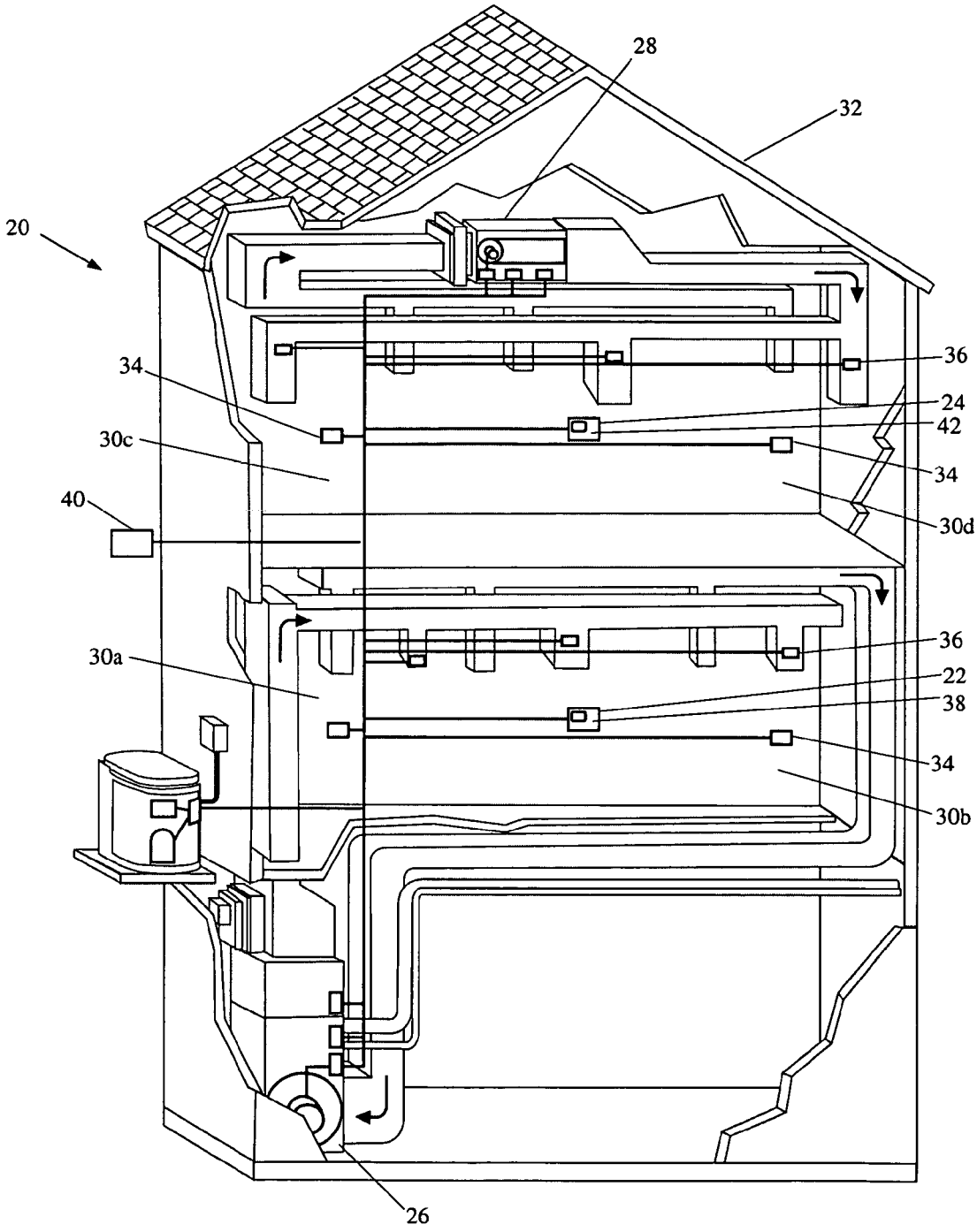
FIG. 1 is an illustration of a first embodiment of a climate control system for multiple zones of a building having a control system in accordance with the principles of the present invention.

One embodiment of a control system for a multi-zone climate control system providing automatic setup of the heating and cooling components in accordance with the principles of the present invention is shown generally at 20 in FIG. 1. The control system generally comprises a one or more thermostats 22 and 24 that control one or more heating and cooling systems 26 and 28 for conditioning one or more zones 30*a*, 30*b*, 30*c*, 30*d* within a building 32. In one preferred embodiment, two or more HVAC systems 26 and 28 may be assigned respectively to two or more thermostats 22 and 24, each of which determines which heating or cooling system corresponds to its zones of control. The interactive system further comprises one or more remote temperature sensors 34, and may further comprise one or more damper controls 36 associated with the one or more zones 30. The thermostats 22 and 24 also determine which of the one or more remote temperature sensors 34 and one or more damper controls 36 correspond to the zones each individual thermostat controls.

In one embodiment, the control system comprises at least one thermostat 22 that automatically initiates a configuration mode upon initial installation and power up. The thermostat 22 begins the configuration by initiating a discovery mode within a network, and queries other thermostats (e.g. thermostat 24), heating and cooling systems (e.g. systems 26 and 28), remote sensors 34 and/or dampers 36 that are subsequently connected to the network. Such discovery by the thermostat 22 may be accomplished by communicating a query request to the network of all devices on the network, which devices may reply by broadcasting identifying information. The information broadcast by each device may include a device code identifying what the device on the network is, and at least one assignment code for identifying what other devices on the network the queried device is assigned to. The discovery allows the thermostat 22 to identify all the components that are not presently assigned to or shared by another thermostat. While the thermostat 22 is preferably configured to transmit and receive signals to the other installed components via wireless communication means, the thermostat 22 is also adapted to be wired to a network such as an RS 485 network. As individual heating and cooling systems 26 and 28, remote sensors 34, or dampers 36 are connected to the network and powered up, the installed components communicate information via the network to the thermostat 22 comprising its device type and its assignment code, if one exists. The installed devices are also preferably configured to transmit and receive signals to the thermostat 22 via wireless communication means, but may communicate via a wired network when the device is connected to such a network. It should be noted that the thermostat 22 may be added to an existing network, in which case the thermostat 22 would query both newly installed devices as well as previously installed devices that have assignment codes to other thermostats in the building. The thermostat 22 accordingly would discover those installed heating and cooling systems 26 and/or 28, remote sensors 34, and dampers 36 that are not assigned to or that are shared by other thermostats.

In some embodiments of the present invention, the self-configuring control system comprises an open network system coordinator device 40 that establishes a master-slave communication protocol for the open network. In these embodiments, system coordinator device would initiate the discovery mode of querying the installed thermostat 22 and other heating and cooling components that are successively installed. The system coordinator device could also query the various components after all the components have been installed, by broadcasting a query to all the installed components for device type information. The installed components would communicate back to the system coordinator device at offset times to avoid collisions of transmission to the system coordinator device. Such communication protocols for staggered transmissions between master-slave devices are prevalently used and well known to those skilled in the art, and will not be disclosed in detail. Where the control system utilizes a system coordinator device, the system coordinator device may become a permanent installation in the control system, or may be removed by a contractor after the control system has been configured. Once the one or more heating and cooling systems and the one or more remote temperature sensors 34 and damper control devices 36 which are unassigned have been identified, the at least one thermostat 22 (or the system coordinator device) will begin an automatic self configuration of the system devices.

Figure 2:
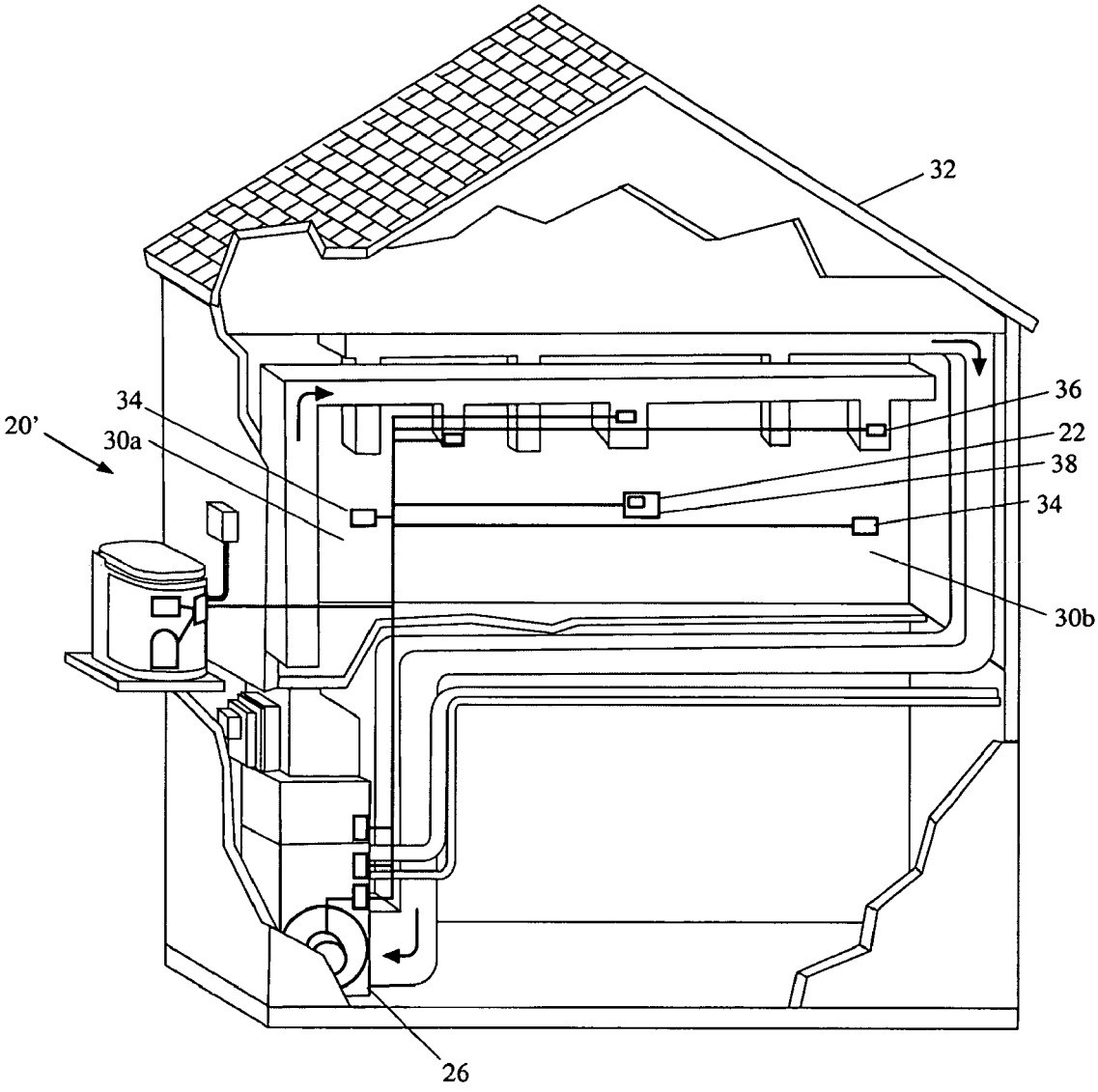
FIG. 2 is an illustration of a second embodiment of a climate control system for multiple zones of a building having a control system in accordance with the principles of the present invention.

In a second embodiment of the present invention shown in FIG. 2, a climate control system 20' for a building 32 is provided that comprises a thermostat 22 having a local temperature sensor 38 and at least one heating or cooling system 26 for conditioning of one or more zones 30 within the building 32. The climate control system further comprises one or more remote temperature sensor devices 34 disposed in at least some of the one or more zones 30 within the building 32. In the control system of this embodiment, the thermostat 22 is adapted to communicate with the at least one heating or cooling system 26 and the one or more remote temperature sensors 34.

The thermostat 22 further includes a set-up mode that initiates the operation of one of the two or more heating or cooling systems that are not assigned to a thermostat, and responsively assigns to the thermostat 22 the operating heating or cooling system that causes a temperature change detected by the local temperature sensor 38 corresponding to the operation of the heating or cooling system. A corresponding temperature change could be an increase of a predetermined number of degrees within a given time period when heating operation is initiated, or could be a decrease of a predetermined number of degrees within a given time period when cooling operation is initiated. In this preferred embodiment of a thermostat, the thermostat 22 may initiate operation of the newly assigned heating or cooling system 26 and responsively assign to the thermostat 22 each unassigned remote temperature sensor device 34 that detect a temperature change within a given time period that corresponds with the temperature change sensed by the local temperature sensor 38.

In this preferred embodiment, the climate control system may further comprise one or more dampers 36 corresponding to at least some of the one or more zones 30 within the building 32, where each damper 36 controllably permits or prohibits the flow of conditioned air to at least one of the zones 30. Where one or more dampers 36 are installed, the thermostat 22 can initiate the operation of the assigned heating or cooling system 26 and closure of all unassigned damper devices 36, such that the thermostat 22 may open one damper 36 and responsively assign the open damper 36 that causes at least one assigned remote temperature sensor 34 to detect an associated temperature change corresponding to the opening of the particular damper device 36. In a similar manner, the thermostat 22 may also operate the heating or cooling system and open all dampers, such that the thermostat 22 may close one damper 36 and responsively assign the open damper 36 that causes at least one assigned remote temperature sensor 34 to detect a corresponding lack of temperature change. The thermostat 22 can successively operate each unassigned damper device 36 in the manner above, and assigns each damper device that causes at least one assigned remote temperature sensor 34 to detect an associated temperature change corresponding to the opening or closing of the particular damper device 36. Accordingly, the thermostat 22 may control the operation of the assigned damper 36 to provide conditioned air to the zones containing the corresponding one or more remote temperature sensors 34.

In the first embodiment shown in FIG. 1, two or more thermostats (e.g.—thermostats 22 and 24) may be used to control two or more heating and cooling systems (e.g.—systems 26 and 28) that may be installed. A first thermostat 22 initiates a set up mode upon initial power up. In the set up mode, the thermostat 22 successively initiates independent operation of each of the unassigned heating or cooling systems 26 and 28, and responsively assigns to the thermostat 22 the particular heating or cooling system that causes a temperature change detected by the local temperature sensor 38 (within thermostat 22) which corresponds to the operation of the selected heating or cooling system. The climate control system 20 may further comprise a second thermostat 24 having a local temperature sensor 42, where the second thermostat 24 device also initiates a set-up mode upon power up. The second thermostat 24 device initiates the operation of one of the two or more heating or cooling systems not assigned to first thermostat 22, and responsively assigns the to the second thermostat 24 the operating heating or cooling system that causes a temperature change sensed by the local temperature sensor 42 which corresponds to the operation of the selected heating or cooling system. For example, after the thermostat 22 initiates heating operation of unassigned heating and cooling system 28 and senses a temperature change, the thermostat 24 assigns its device code to the heating and cooling system 28.

The second thermostat 24 may also initiate operation of a heating or cooling system assigned to another thermostat (e.g.—thermostat 22) and communicate with the first thermostat to compare the rate of temperature change sensed by the first thermostat to the rate of temperature change sensed by the second thermostat. This allows the second thermostat 24 to verify whether a currently assigned heating or cooling system (e.g.—system 26) would more effectively condition the area of the second thermostat 24 than the area of the first thermostat, in which case the system would be more appropriately controlled by the second thermostat. The second thermostat could then assign its thermostat device code to the assigned heating or cooling system in place of the existing thermostat device code.

The climate control system 20 further comprises one or more remote temperature sensor devices 34 in one or more zones 30 within the space. After the heating or cooling system 28 is assigned to the second thermostat 24, the second thermostat 24 device can initiate the operation of an assigned heating or cooling system 28 and responsively assign to the second thermostat 24 each unassigned remote temperature sensor device 34 that detects a temperature change corresponding with the temperature change sensed by the local temperature sensing device 42 of the second thermostat 24. A corresponding temperature change could be an increase of a predetermined number of degrees within a given time period when heating operation is initiated, or could be a decrease of a predetermined number of degrees within a given time period when cooling operation is initiated. The thermostat 24 can initiate operation of an assigned heating or cooling system 28 and responsively assign to the thermostat 22 each unassigned remote temperature sensor device 34 that detect a temperature change within a given time period that corresponds with the temperature change sensed by the local temperature sensor 38.

Likewise, the thermostat 24 can operate an assigned heating or cooling system 28, and can obtain the temperature from a remote temperature sensor 34 assigned to another thermostat (e.g. thermostat 22). The second thermostat 24 can communicate with the first thermostat to compare the rate of temperature change transmitted by the remote sensor during operation of the first thermostat with the rate of temperature change transmitted by the remote sensor during operation of the second thermostat 24 and assigned heating or cooling system 28. This allows the second thermostat 24 to verify whether a remote temperature sensor 34 currently assigned to a first thermostat (e.g. thermostat 22) would more effectively sense temperature changes resulting from the second thermostat 24 and heating or cooling system 28 than temperature changes resulting from the first thermostat. The second thermostat could then assign its thermostat device code to the assigned remote temperature sensor 34 in place of the existing thermostat device code.

The climate control system 20' may further comprise one or more dampers 36 corresponding to each of the one or more zones 30 within the building 32, where each damper 36 controllably permits the flow of conditioned air to each respective zone 30. The thermostat 24 can initiate the operation of its assigned heating or cooling system 28 and closure of all unassigned damper devices 36, such that the thermostat 24 may open one damper 36 and responsively assign the open damper 36 that causes at least one assigned remote temperature sensor 34 to detect an associated temperature change corresponding to the opening of the particular damper device 36. In a similar manner, the thermostat 24 may also operate the heating or cooling system 28 and open all dampers, such that the thermostat 22 may close one damper 36 and responsively assign the open damper 36 that causes at least one assigned remote temperature sensor 34 to detect a corresponding lack of temperature change. The second thermostat 24 device can initiate the operation of the assigned heating or cooling system 28, and can successively operate each of the one or more unassigned damper devices 36, such that the second thermostat 24 may responsively assign each opened or closed damper device 36 that causes at least one remote temperature sensors 34 assigned to the second thermostat 24 to detect an associated temperature change corresponding to the opened or closed damper device 34. Accordingly, the thermostat 24 may control the operation of each assigned damper 36 to provide conditioned air to the zones containing the corresponding one or more remote temperature sensors 34.

In operation, the first embodiment of a climate control system 20 as shown in FIG. 1 would be initially set up as follows. The first thermostat 22 would initiate a set up mode upon power up and establishing communication via the network. The thermostat 22 would then broadcast a query request to initiate discovery, in which a plurality of remote temperature sensors 34, dampers 36, and first and second heating and control systems 26 and 28 would respond to by transmitting an identification signal. The signal would comprise a device code for identifying the device (e.g.—system, sensor, ect.), but would not comprise an assignment code at initial set up. The thermostat 22 would then initiate independent operation of each of the unassigned heating or cooling systems, such as system 28, and would responsively assign system 28 to the thermostat 22 if the heating or cooling system 28 caused at least a minimum temperature change within a given time period (e.g. −1° Fahrenheit/15 minutes) that the local temperature sensor 38 within thermostat 22 could sense. For example, if after fifteen minutes of heating operation of system 28, the thermostat 22 did not sense at least a 1° temperature change, the thermostat would not assign the device code of thermostat 22 to the heating or cooling system 28. The thermostat 22 would then initiate independent operation of the second heating or cooling system 26, and would responsively assign system 26 to the thermostat 22 if the heating or cooling system 26 caused at least a minimum temperature change within a given time period. If after fifteen minutes of heating operation of system 26, the thermostat's local temperature sensor sensed a 2° temperature change, the thermostat would assign its device code via the network to the heating or cooling system 26. The thermostat 22 may also be adapted to save the 2° change in a 15 minute period in memory.

After the thermostat 22 has assigned its device code to heating or cooling system 26, the thermostat 22 can initiate the operation of an assigned heating or cooling system 26 and responsively assign each unassigned remote temperature sensor device 34 that detects a temperature change temperature change within a given time period that corresponds with the temperature change sensed by the local temperature sensor 38. For example, if the remote temperature sensor 34 in zone 30*c* transmitted a sensed temperature that had increased 1° after fifteen minutes of heating operation of system 26, the thermostat would assign its device code via the network to the remote temperature sensor 34 in zone 30*c*. Likewise, if the remote temperature sensor 34 in zone 30*b* transmitted a sensed temperature that had increased 2° after fifteen minutes of heating operation of system 26, the thermostat would assign its device code via the network to the remote temperature sensor 34 in zone 30*a*. The thermostat 22 would proceed to assign each of the remaining remote temperature sensors identified in discovery in this manner.

The thermostat 22 can broadcast a request via the network to close all unassigned damper devices 36. The thermostat 22 could then initiate heating operation of system 26 and open damper device 36 in zone 30*b*. If the remote temperature sensor 34 in zone 30*b* transmitted a sensed temperature that had increased 2° after fifteen minutes of heating operation of system 26, the thermostat 22 would assign its device code via the network to the damper 36 in zone 30*b* that causes remote sensor in 30*b* to detect the temperature change corresponding to the opening of the damper in zone 30*b*. Alternatively, if the thermostat 22 then opened damper 36 in zone 30*d* and the remote sensor 34 in zone 30*d* transmitted a sensed temperature that had increased only a ½° after fifteen minutes of heating operation, the thermostat 22 would not assign its device code via the network to the damper in zone 30*d*. The thermostat 22 would proceed to assign each of the remaining zone dampers identified in discovery in this manner.

The second thermostat 24 may also initiate a set up mode upon powering up and establishing communication via the network. The thermostat 24 would then broadcast a query request to initiate discovery, in which a plurality of remote temperature sensors 34, dampers 36, and first and second heating and control systems 26 and 28 would respond by transmitting identification signals, some of which would include assignment codes associated with thermostat 22. The second thermostat 24 device would then initiate the operation of unassigned heating or cooling system 28. If after fifteen minutes of heating operation of system 28, the thermostat's local temperature sensor 42 sensed a 2° temperature change, the thermostat 24 would assign its device code via the network to the heating or cooling system 28.

The second thermostat 24 may also initiate operation of heating or cooling system 26 assigned to another thermostat (e.g.—thermostat 22) and communicate with the first thermostat to compare the saved rate of temperature change sensed by the first thermostat 22 to the rate of temperature change sensed by the second thermostat 24. If the second thermostat 24 sensed a ½° temperature increase after fifteen minutes of heating operation of system 26, the second thermostat 22 would be able to compare the 1/20 temperature change rate it sensed with the 2° temperature change rate sensed by the first thermostat 22. The second thermostat 24 would then be able to confirm that the heating or cooling system 26 would not be more appropriately controlled by the second thermostat 24.

After the second thermostat 24 has assigned its device code to heating or cooling system 28, the thermostat 24 can initiate the operation of an assigned heating or cooling system 28 and responsively assign each unassigned remote temperature sensor device 34 that detects a temperature change temperature change within a given time period that corresponds with the temperature change sensed by the local temperature sensor 38. For example, if the remote temperature sensor 34 in zone 30d transmitted a sensed temperature that had increased 2° after fifteen minutes of heating operation of system 28, the thermostat 24 would assign its device code via the network to the remote temperature sensor 34 in zone 30*d*.

The second thermostat 24 may also obtain the sensed temperature from a remote temperature sensor 34 in zone 30*c* having an assignment code of the first thermostat 22. The second thermostat 24 can communicate with the first thermostat 22 to compare the rate of temperature change transmitted by the remote sensor during operation of the first thermostat 22 with the rate of temperature change transmitted by the remote sensor during operation of the second thermostat 24 and assigned heating or cooling system 28. If the remote temperature sensor 34 in zone 30*c* transmitted a sensed temperature that had increased 2° after fifteen minutes of heating operation of system 28, the second thermostat 22 would be able to compare the 2° temperature change rate sensed in zone 30*c* during operation of system 28 with the 1° temperature change rate sensed in zone 30*c* during operation of the first thermostat 22 and system 26. The second thermostat 24 would then be able to confirm that the remote temperature sensor 34 in zone 30*c* would be more appropriately assigned to second thermostat 24 and system 28. The thermostat 24 would then assign its device code in place of the first thermostat's device code to the remote temperature sensor in zone 30*c*.

The thermostat 24 can broadcast a request via the network to close all unassigned damper devices 36. The thermostat 24 could then initiate heating operation of system 28 and open damper device 36 in zone 30*d*. If the remote temperature sensor 34 in zone 30*d* transmitted a sensed temperature that had increased 2° after fifteen minutes of heating operation of system 28, the thermostat 24 would assign its device code via the network to the damper 36 in zone 30*d* that causes remote sensor in 30*d* to detect the temperature change corresponding to the opening of the damper in zone 30*d*. The second thermostat 24 would then proceed to assign each of the remaining unassigned zone dampers identified in discovery in this manner.

Figure 3:
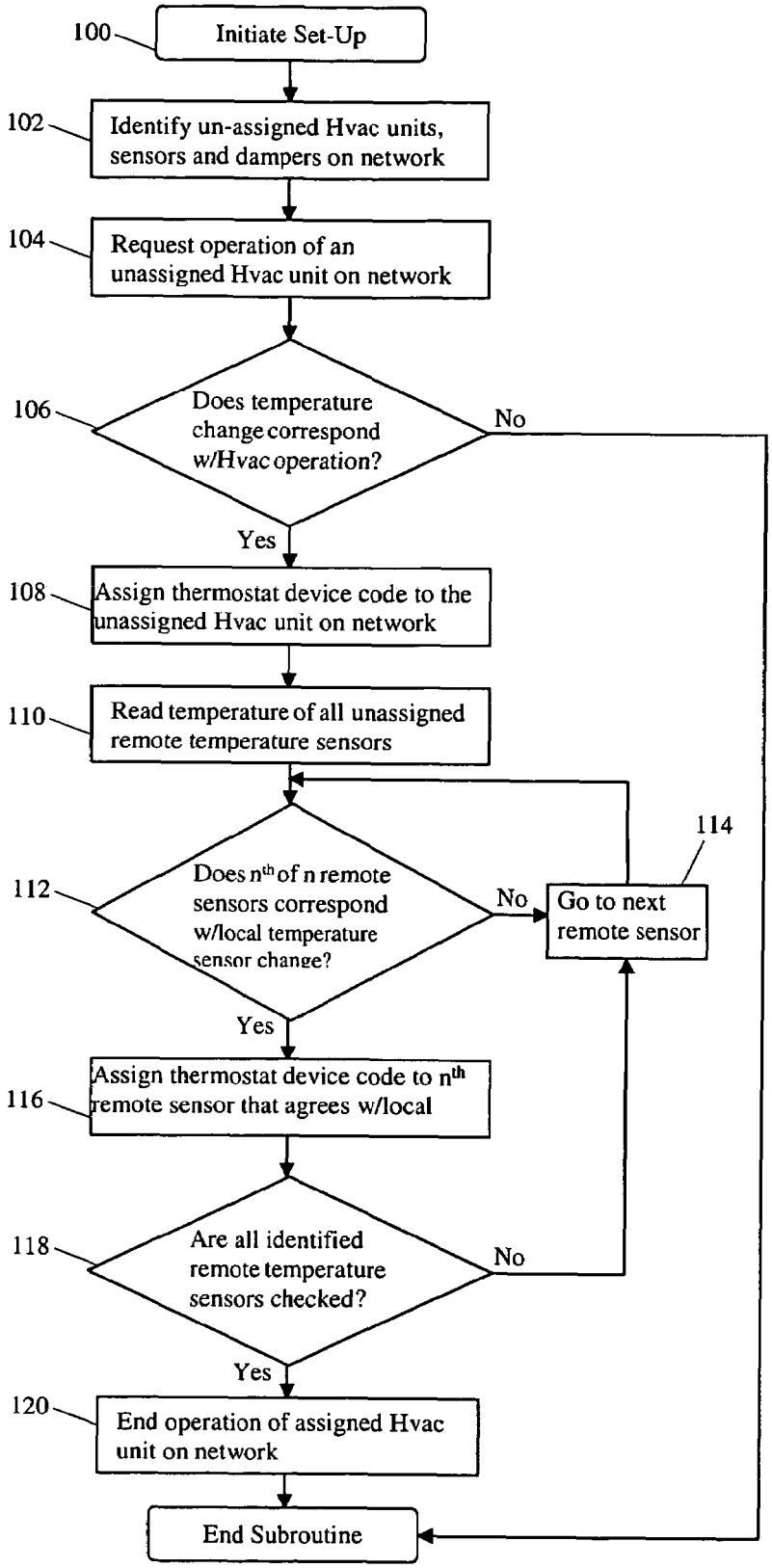
FIG. 3 is flow chart illustrating one embodiment of a method for automatically setting up the control system for a multi-zone climate control system.

FIG. 3 illustrates one embodiment of a method for controlling the set up of a climate control system in a flow chart. The method provides for controlling set-up of a climate control system having at least one thermostat and at least one heating or cooling system 26 and/or 28 for conditioning one or more zones 30 within a building 32. Specifically, the method comprises initiating a set-up mode in at least one thermostat 22 at step 100. The method proceeds at step 102 with the thermostat 22 identifying at least one unassigned heating or cooling system 26, 28 and one or more remote sensors 34 associated with the thermostat 22. The thermostat 22 then requests initiating the operation of an unassigned heating or cooling system at step 104. The thermostat 22 senses or monitors the temperature of the space local to the thermostat, and determines at step 106 if the temperature change of the space local to the thermostat 22 corresponds to the system operation. For example, if the thermostat initiates heating operation of an unassigned heating and cooling system 26 and senses a corresponding increase in the temperature local to the thermostat, the thermostat 22 would assign the thermostat's device code to the heating and cooling system 26 at step 108. Thus, the thermostat 22 could subsequently activate the assigned heating or cooling system 26 to increase the temperature of the space local to the thermostat 22 to a desired level.

The method further comprises the step 110 of the thermostat 22 reading the temperature sensed by one or more unassigned remote temperature sensors 34 in at least one of the one or more zones 30. The thermostat 22 determines at step 112 if the remote sensor's temperature change corresponds to the temperature change local to the thermostat 22 during system operation. The thermostat 22 accordingly assigns the thermostat's device code to each unassigned remote temperature sensor 34 that senses a temperature change in a zone corresponding with the change in local temperature of the thermostat 22 at step 116, for each of the "n" number of sensors. Thus, an assigned remote temperature sensor 34 could subsequently sense a decrease in temperature of a particular zone 30 in the building 32, which the thermostat 22 would respond to by activating the assigned heating system 26 to increase the temperature of the particular zone 30 in the building 32 having the assigned remote temperature sensor 34.

The method may further comprise the step of thermostat 22 closing at least one unassigned damper device 36 where a damper device is installed during operation of the system, to prohibit flow of conditioned air to at least one of the one or more zones 30. The method could likewise open the at least one unassigned damper device 36 to permit the flow of conditioned air to at least one of the one or more zones 30. The thermostat 22 would then assign any opened or closed damper 36 that causes an assigned remote temperature sensor 34 to detect an associated temperature change in the zone 30 corresponding to the opening or closing of the particular damper device 36. Specifically, the method can close all of the dampers and successively open each of the one or more damper devices 36, such that the thermostat 22 may responsively assign each opened damper device 36 that causes an assigned remote temperature sensor 34 to detect an associated temperature change corresponding to the opening of the particular damper device 36. The method can also close a damper to prohibit the flow of conditioned air to one or more zones, such that the thermostat 22 may responsively assign the closed damper that causes one or more remote temperature sensors to detect an associated temperature change corresponding to the closing of the particular damper 36.

The method may further comprise repeating the above steps to provide for set up of a second thermostat 24 for controlling a second heating and cooling system 26 or 28 for one or more zones 30 within a building 32. The method provides for initiating a set-up mode of a second thermostat 24 having a sensor 42 for sensing the temperature local to the second thermostat, and for identifying at least one unassigned heating or cooling system associated with the second thermostat. The second thermostat initiates the operation of an unassigned heating or cooling system, and senses or monitors the temperature of the space local to the second thermostat 24 to determine whether to assign the operating heating or cooling system to the second thermostat. For example, if in response to initiating operation of the heating system 28 the thermostat 24 detects an increase in temperature of the space local to the second thermostat 24, the thermostat 24 would assign the operating heating or cooling system 28 to the thermostat 24.

The method then proceeds with the thermostat 24 reading the temperature sensed by at least one unassigned remote temperature sensor 34 in at least one of the one or more zones 30, and assigning to the second thermostat 24 at least one remote temperature sensor 34 for the at least one zone 30 when the temperature change sensed by the remote sensor 34 corresponds with the change in temperature of the space local to the second thermostat 24. Where the climate control system comprises dampers 36, the second thermostat 24 would also operate at least one unassigned damper device 36 to permit or prohibit flow of conditioned air to at least one of the one or more zones, and assign to the second thermostat 24 the at least one damper 36 that causes a remote temperature sensor 34 assigned to the second thermostat 24 to detect an associated temperature change in the zone 30 corresponding to the opening or closing of the particular damper device 36.

After set up of the multi-zone control system, which may comprise one or more thermostats for controlling one or more heating and cooling systems 26 and/or 28 and one or more remote temperature sensors 34 and dampers 36, the method provides for each thermostat 22 and 24 to control the operation of assigned heating or cooling systems 26 and/or 28 and any assigned dampers 36 in response to the temperature sensed by the temperature sensor local to each thermostat 22 and 24 and any assigned remote temperature sensors 34, to provide conditioned air to the one or more zones 30 for maintaining a desired temperature in the building 32.

The advantages of the above described embodiment and improvements should be readily apparent to one skilled in the art, as to enabling control of a multi-zone heating and cooling system. Additional design considerations may be incorporated without departing from the spirit and scope of the invention. Accordingly, it is not intended that the invention be limited by the particular embodiment or form described above, but by the appended claims.

What is claimed is:

1. A climate control system for conditioning one or more zones within a building, the control system comprising:

two or more heating or cooling systems for conditioning of the one or more zones within the building;

one or more remote temperature sensor devices disposed in at least some of the one or more zones within the building; and a thermostat having a local temperature sensor, the thermostat being adapted to communicate with the two or more heating and cooling systems and the one or more remote temperature sensors, wherein the thermostat operates a set-up mode that initiates the operation of one of the two or more heating or cooling systems and responsively assigns the heating or cooling system to the thermostat where the local temperature sensor detects a temperature change corresponding to the operation of the heating or cooling system.

2. The climate control system of claim 1, wherein the thermostat successively initiates operation of each of the two or more heating or cooling systems, and responsively assigns the particular heating or cooling system to the thermostat when the local temperature sensor detects a temperature change corresponding to the operation of the heating or cooling system.

3. The climate control system of claim 2, wherein the thermostat initiates the operation of an assigned heating or cooling system and responsively assigns to the thermostat each remote temperature sensor device that detects a temperature change corresponding with the temperature change sensed by the local temperature sensor.

4. The climate control system of claim 3, further comprising one or more dampers corresponding to at least some of the one or more zones within the building, where each damper controllably prohibits or permits the flow of conditioned air to at least one of the zones.

5. The climate control system of claim 4, wherein the thermostat initiates the operation of an assigned heating or cooling system and successively operates each of the one or more damper devices, such that the thermostat may responsively assign each damper device that causes an assigned remote temperature sensor to detect an associated temperature change corresponding to the opening or closing of the particular damper device.

6. The climate control system of claim 5, further comprising a second thermostat having a local temperature sensor, where the second thermostat initiates the operation of one of the two or more heating or cooling systems not assigned to first thermostat, and responsively assigns the heating or cooling system to the second thermostat where the local temperature sensor detects a temperature change corresponding to the operation of the heating or cooling system.

7. The climate control system of claim 6, wherein the second thermostat initiates the operation of its assigned heating or cooling system and responsively assigns to the second thermostat each unassigned remote temperature sensor device that detects a temperature change corresponding with the temperature change sensed by the local temperature sensor of the second thermostat.

8. The climate control system of claim 7, wherein the second thermostat initiates the operation of its assigned heating or cooling system and successively operates each of the one or more unassigned damper devices, such that the second thermostat may responsively assign each damper device that causes a remote temperature sensor assigned to the second thermostat to detect an associated temperature change corresponding to the opening or closing of the particular damper device.

9. A climate control system for conditioning one or more zones within a building, the control system comprising:

two or more heating or cooling systems for conditioning of the one or more zones within the building;

one or more remote temperature sensor devices disposed in at least some of the one or more zones within the building;

a thermostat having a local temperature sensor, the thermostat being adapted to communicate with the two or more heating and cooling systems and the one or more remote temperature sensors, and a control device adapted to communicate with the thermostat, the two or more heating and cooling systems and the one or more remote temperature sensors, wherein the control device operates a setup mode that initiates the operation of one of the two or more heating or cooling systems and responsively assigns the heating or cooling system to the thermostat where the local temperature sensor detects an associated temperature change within a given time period that corresponds to the operation of the one heating or cooling system.

* * * * *